United States Patent [19]

Kihara

[11] 3,964,137

[45] June 22, 1976

[54] SLIDE FASTENER

[75] Inventor: Toshiyuki Kihara, Kurobe, Japan

[73] Assignee: Yoshida Kogyo Kabushiki Kaisha, Japan

[22] Filed: May 1, 1974

[21] Appl. No.: 465,997

[30] Foreign Application Priority Data

May 8, 1975 Japan ..... 48-51479

[52] U.S. Cl. ..... 24/205.16 R; 24/205.13 D; 24/205.11 F

[51] Int. Cl.[2] ..... A44B 19/40

[58] Field of Search ..... 24/205.16 D, 205.16 R

[56] References Cited

UNITED STATES PATENTS

| | | | |
|---|---|---|---|
| 2,832,119 | 4/1958 | Neitlich | 24/205.11 F |
| 2,903,775 | 9/1959 | Johns | 24/205.16 |
| 3,141,217 | 7/1964 | Jones | 24/205.13 D |
| 3,490,098 | 1/1970 | Frohlich | 24/205.13 D |
| 3,505,710 | 4/1970 | Frohlich | 24/205.11 F |
| 3,663,996 | 5/1972 | Heimberger | 24/205.11 F |
| 3,685,474 | 8/1972 | Frohlich | 24/205.16 C |

*Primary Examiner*—Bernard A. Gelak
*Attorney, Agent, or Firm*—Buchnam and Archer

[57] ABSTRACT

A slide fastener is disclosed which comprises a pair of stringer tapes of a warp-knitted structure including wales and fastener component parts attached to the tapes. These fastener component parts are made of a thermoplastic material and attached by injection, extrusion, supersonic or high-frequency heating to the stringer tape or tapes. The resulting tape or tapes are provided with the material of the fastener component parts extended into and through the interstices of the knitted structure and further into the wales so as to provide increased stability of the parts against displacement or detachment under severe stresses.

2 Claims, 8 Drawing Figures

SLIDE FASTENER

BACKGROUND OF THE INVENTION

This invention relates to slide fasteners and more particularly to a slider-operated slide fastener having a pair of stringer tapes constructed with a warp-knitted structure. The invention is directed to the provision of a firm bondage between the stringer tapes and various fastener component parts.

The term fastener component parts herein referred to includes a row of interlocking fastener elements or teeth, a top and a bottom end stop and associated reinforcing members, all such component parts being made of a thermoplastic resin such as polyethylene, polypropylene, polyvinyl chloride and the like.

Heretofore, slide fasteners are known which comprise woven stringer tapes carrying the aforesaid fastener component parts. In such conventional woven type of slide fasteners, however, the fastener component parts were bonded in place in such a manner that they were either deposited on exposed surfaces of the tapes or permeated only through part of the surface layers of the tapes. Such conventional slide fasteners have therefore sufferrred from the drawback that the fastener component parts are liable to move out of place or become detached from the stringer tapes after repreated use of the fastener.

SUMMARY OF THE INVENTION

Whereas, it is an object of the present invention to provide a slide fastener of a knitted structure which is characterized by the provision of a firm, stable bondage of the fastener component parts to their supporting stringer tapes.

This object together with other features of the invention will be more apparent from the following description taken in conjunction with the accompanying drawings which illustrate by way of example certain preferred embodiments.

BRIEF DESCRIPTION OF THE DRAWINGS

Like reference characters or numerals are used to designate like parts throughout the several views.

DESCRIPTION OF THE PREFERRED EMBODIMENTS

Figure 1:
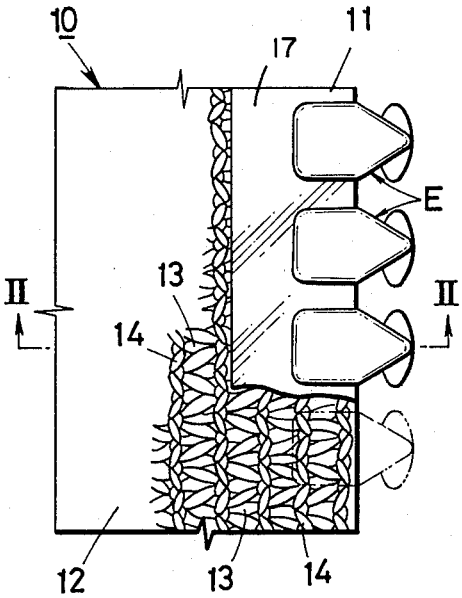
FIG. 1 is a plan view of a stringer tape carrying along one longitudinal edge thereof a row of fastener elements.
Figure 2:
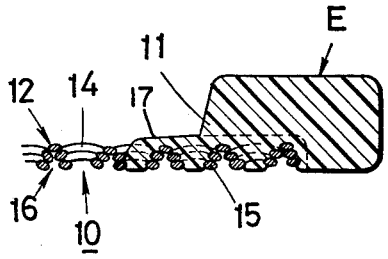
FIG. 2 is a transverse cross-sectional view taken on the line II---II of FIG. 1.

Referring now to the drawings and FIGS. 1 and 2 in particular, there is diagrammatically shown a fastener stringer tape 10 of a warp-knitted structure consisting for example of wale-forming threads or chain stitches, tricot stitches and transverse laid-in stitches formed on a three-bar knitting machine. This is embodiment concerned with a fastener component part which is a row of interlocking fastener elements E made of a thermoplastic material 11 of the class above mentioned and arranged in discrete formation. The fastener elements E are attached to a flat side 12 of the tape 10 as better shown in FIG. 2, by means of extrusion or injection molding whereby the plastic material 11 in molten condition penetrates into and through interstices 13 between adjacent knitted threads 14 of the tape 10 and fills in the interstices 13. Importantly, according to the invention, the molten plastic material 11 is extended further into and form an integral bond with wales 15 on the reverse side 16 of the tape 10. In order to further stabiize the position of the fastener elements E on the tape 10, there is provided an elongated strip 17 of thermoplastic material extending along a longitudinal edge of the tape 10 and secured together with the fastener elements E thereto by extrusion or injection process in a manner described. With the fastener elements E and/or their supporting strip 17 thus firmly anchored in place on the stringer tape 10, the elements E can be engaged with and disengaged from those on a companion stringer tape (not shown) and can be retained in position against displacement for extended periods of service time, with increased stability, thus overcoming the problem of weakness of the knitted fabric.

Figure 3:
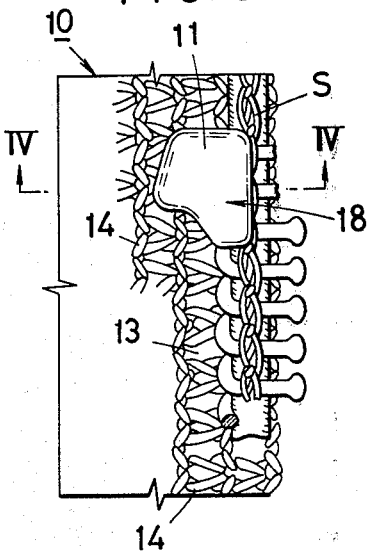
FIG. 3 is a plan view of a stringer tape having provided thereon a top end stop.
Figure 4:
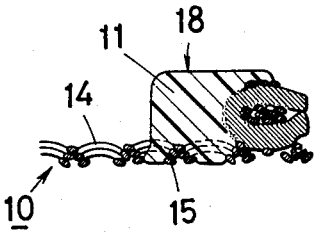
FIG. 4 is a transverse cross-sectional view taken on the line IV—IV of FIG. 3.

The embodiment shown in FIGS. 3 and 4 is directed to the provision of a top end stop 18 made of a similar thermoplastic material which is attached to the stringer tape 10 by means for example of high-frequency heating or supersonic process. The top end stop 18 is conventional in form and shown fused together with the fastener elements E that are secured by stitchings S to the tape 10. The material 11 of the top end stop 18 is, as better seen in FIG. 4, extended into and through the interstices 13 and further into the region of wales 15 which is stronger and more rigid than the remaining web of the tape 10.

Figure 5:
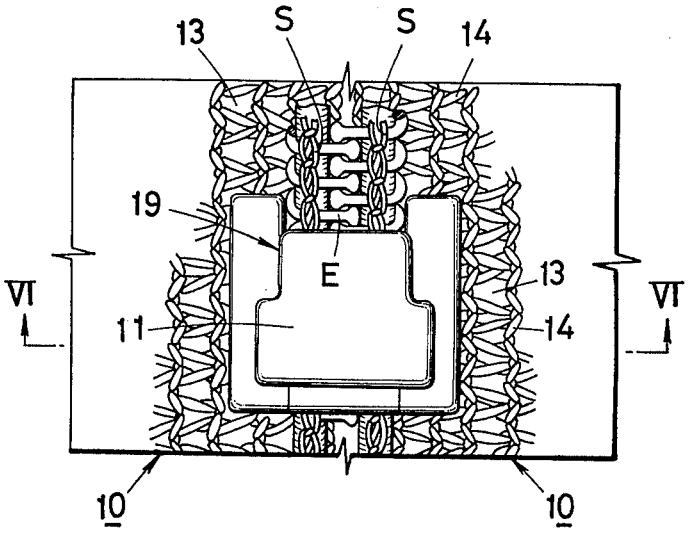
FIG. 5 is a plan view of a pair of coupled stringer tapes having provided thereon a bottom end stop.
Figure 6:
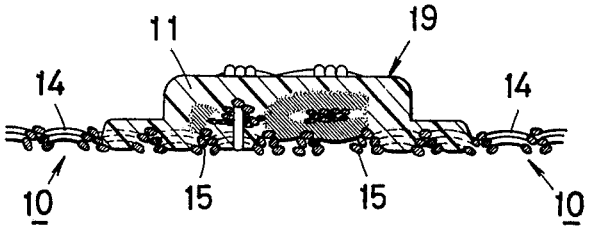
FIG. 6 is a transverse cross-sectional view taken on the line VI—VI of FIG. 5.

FIGS. 5 and 6 illustrate the invention as being applied to a bottom end stop 19 of conventional form which is bridged over the interengaged fastener elements E and fused together therewith into the tape 10. As better shown in FIG. 6, the material 11 of the bottom end stop 19 fills the interstices 13 and forms an integral bond with the wales 15 of the knitted tape 10.

Figure 7:
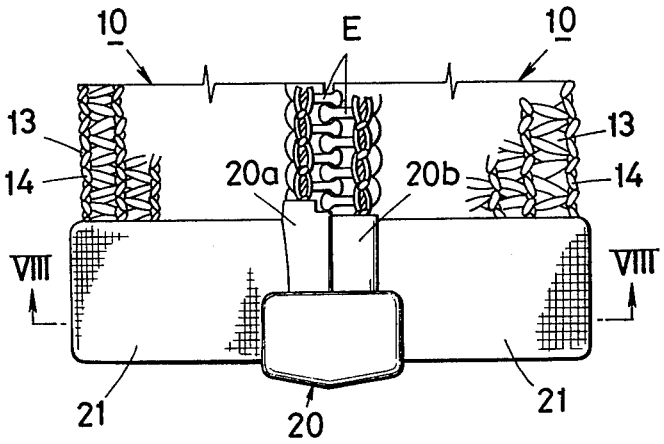
FIG. 7 is a plan view of a pair of coupled stringer tapes having provided thereon a separable type of bottom end stop.
Figure 8:
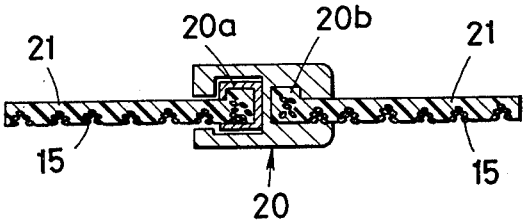
FIG. 8 is a transverse cross-sectional view taken on the line VIII—VIII of FIG. 7.

The embodiment shown in FIGS. 7 and 8 is concerned with a separable bottom end stop 20 to which the principles of the invention are applied. This end stop is also of conventional construction including a pin member 20*a* and a box member 20*b*. A reinforcing film 21 is attached together with these members to each of the oppositely disposed stringer tapes 10. The reinforcing film 21, being thermoplastic, can be attached to the tape 10 by means of high-frequency heating, supersonic process, or with heat and pressure in the well known manner. In this embodiment also, it is important that the material 11 of the film 21 flows into and through the interstices 13 of the knitted tape 10 and further into the region of wales 15 for reasons herein above advanced. The attachment of this separable end stop 20 and its reinforcing film 21 to the tapes 10 may be made by injection molding as will readily occur to those skilled in the art.

Having thus described the invention, it will be understood that the exact form and construction of the vari-ous fastener component parts disclosed do not form any positive part of the invention. However, the important aspect of the invention resides in the provision of a slide fastener having such fastener component parts securely retained in place against displacement or detachment under the influence of severe stresses.

What is claimed is:

1. A slide fastener comprising a pair of oppositely disposed stringer tapes of a warp-knitted structure having wales and interstices between adjacent knitting threads and a series of discrete fastener elements made of a thermoplastic material attached to one longitudinal marginal edge of each of said stringer tapes, said fastener elements being secured to one surface of the tape and said marginal edge thereof in such a manner that the material of the fastener elements penetrates into and through said interstices to fill the latter up and is extended further up to the region of the wales on the reverse of the tape thereby forming an integral bond with the wales underlying said fastener elements.

2. A slide fastener as defined in claim 1 further comprising an elongated strip made of a thermoplastic material extending along said longitudinal marginal edge and secured together with the fastener elements to said one surface of the tape in such a manner that the material of said strip penetrates into and through said interstices to fill the latter up and is extended further up to the region of the wales on the reverse side of the tape.

* * * * *